US005090701A

United States Patent [19]

Chang

[11] Patent Number: 5,090,701

[45] Date of Patent: Feb. 25, 1992

[54] JIGSAW PUZZLE

[76] Inventor: Morgan Chang, No. 291, Sec. 1, Chang Nan Rd., Chang Hua City, Taiwan

[21] Appl. No.: 728,163

[22] Filed: Jul. 10, 1991

[51] Int. Cl.[5] ..... A63F 9/10

[52] U.S. Cl. ..... 273/157 R

[58] Field of Search ..... 273/157 R, 157 A; 434/333, 335, 339, 340, 343, 344, 224, 301

[56] References Cited

U.S. PATENT DOCUMENTS

| | | | |
|---|---|---|---|
| 2,505,230 | 4/1950 | Composto | 434/343 |
| 2,656,617 | 10/1953 | Composto | 434/343 |
| 2,918,287 | 12/1959 | Rosenblum et al. | 434/224 X |
| 2,923,550 | 2/1960 | Blackman et al. | 434/343 X |
| 3,015,895 | 1/1962 | Stall | 273/157 R X |
| 3,633,074 | 1/1972 | Nojiri | 434/301 X |
| 4,023,807 | 5/1977 | Santianni | 434/340 X |
| 4,893,817 | 1/1990 | Shilo | 434/333 X |

*Primary Examiner*—William H. Grieb

*Attorney, Agent, or Firm*—Mathews, Woodbridge & Collins

[57] ABSTRACT

A jigsaw puzzle including a base, a number of conductors disposed on the base and arranged in a line, a switch disposed between every two adjacent conductors, a number of jigsaw pieces can be disposed upon the switch, a sounding device connected between two of the conductors and sending out a sound when all of the switches are depressed by the jigsaw pieces and when all of the jigsaw pieces are correctly disposed in place.

6 Claims, 5 Drawing Sheets

JIGSAW PUZZLE

BACKGROUND OF THE INVENTION

1. Field of the Invention

The present invention relates to a jigsaw puzzle, and more particularly to a jigsaw puzzle which sends out a musical sound or the like when the jigsaw puzzle is completed.

2. Description of the Prior Art

Typical jigsaw puzzles comprise a plurality of jigsaw pieces arrangeable on a board so as to form a completed picture plane or the like. For conventional jigsaw puzzles, no musical sound or voice is sent when the picture plane of the jigsaw puzzle is completed.

The present invention has arisen to mitigate and/or obviate the afore-described disadvantages of the conventional jigsaw puzzles.

SUMMARY OF THE INVENTION

The primary objective of the present invention is to provide a jigsaw puzzle which sends out a musical sound or a voice when the the picture plane of the jigsaw puzzle is completed.

In accordance with one aspect of the invention, there is provided a jigsaw puzzle which includes a base, a number of conductors disposed on the base and arranged in a line, a switch disposed between every two adjacent conductors, a number of jigsaw pieces can be disposed upon the switch, a sounding device connected between the first conductor and the last conductor and sending out a sound when all of the switches are depressed by the jigsaw pieces and when all of the jigsaw pieces are correctly disposed in place.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
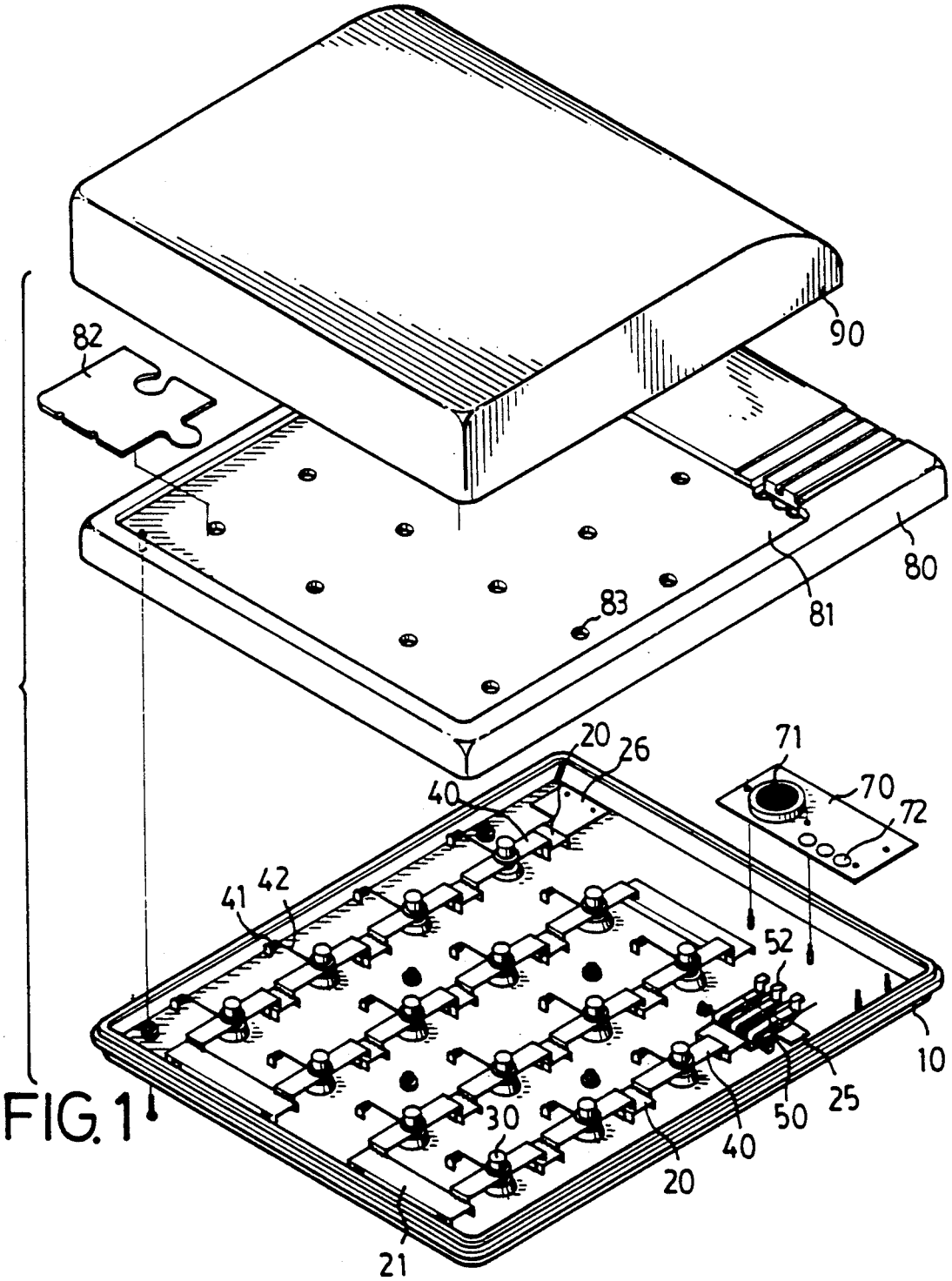
FIG. 1 is an exploded view of a jigsaw puzzle in accordance with the present invention.

Referring to the drawings and initially to FIG. 1, a jigsaw puzzle in accordance with the present invention comprises generally a base 10 having a plurality of conductors 20, 21 and switching means 30 and a speaker 71 disposed thereon, a board 80 disposed upon the base 10 and having a recess 81 formed in the upper surface thereof for receiving a plurality of jigsaw pieces 82, and, optionally, a cover 90 disposed upon the board 80 for covering the jigsaw pieces 82. The speaker 71 will send out a musical sound or a voice when all of the switching means 30 are depressed by one set of jigsaw pieces 82 which are correctly arranged within the recess 81 of the board 80. A plurality of holes 83 are formed in the board 80.

The conductors 20 are arranged in four lines and the conductors 21 are alternatively disposed on the end portions of every two adjacent lines of conductors 20 so that a line of circuit which is substantially W-shaped is formed, and a switching means 30 is disposed between every two adjacent conductors 20, 21 of the line. The length of the conductors 21 is longer than that of the other conductors 20.

Figure 2:
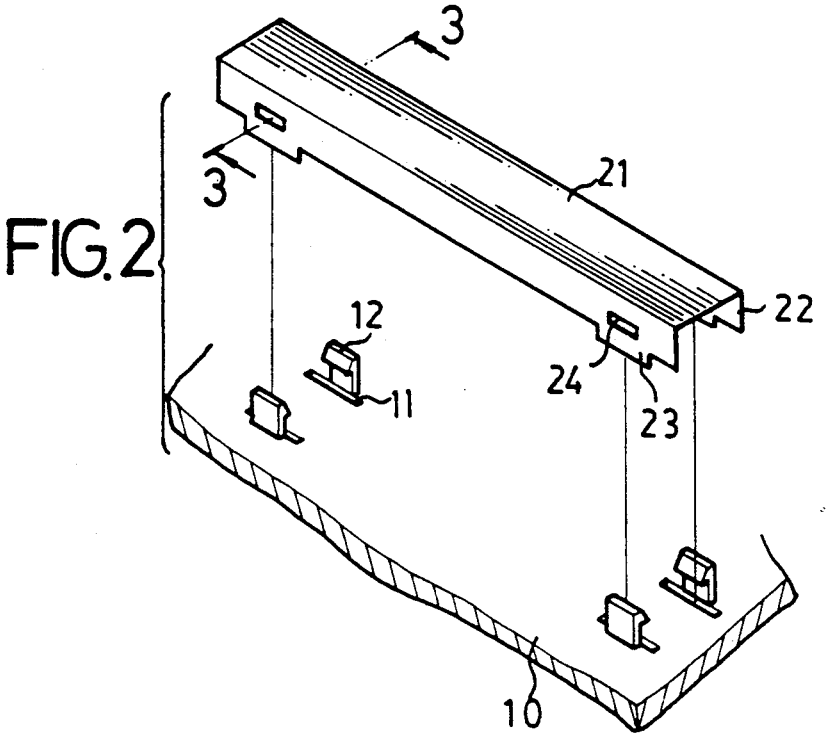
FIG. 2 is an exploded view of a conductor.
Figure 3:
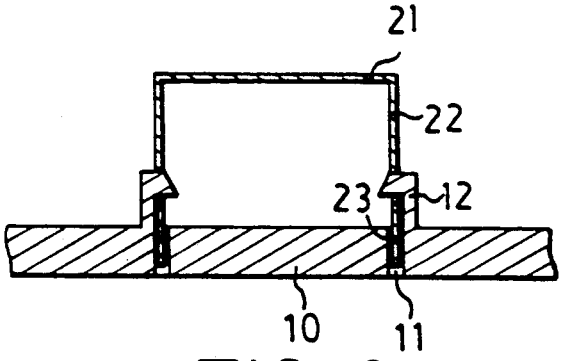
FIG. 3 is a cross sectional view taken along lines 3—3 of FIG. 2.

Referring next to FIGS. 2 and 3, each of the conductors 20, 21 has a substantially inverted U-shaped cross section including two side walls 22 depending downward therefrom. Two lugs 23 and two depressions 24 are formed on each side of each of the side walls 22 of the conductors 21; however, only one lug 23 and one depression 24 are formed in each of the side walls 22 of the conductors 20. A plurality of slots 11 are formed in the base 10, and each of the slots 11 receives a lug 23 of the conductors 20, 21. A hook 12 is disposed beside each of the slots 11 and is engageable with the depressions 24 of the conductors 20, 21 so that the conductors 20, 21 can be retained in place. An extension 25, 26 extends from the first and the last of the conductors 20 respectively.

Figure 4:
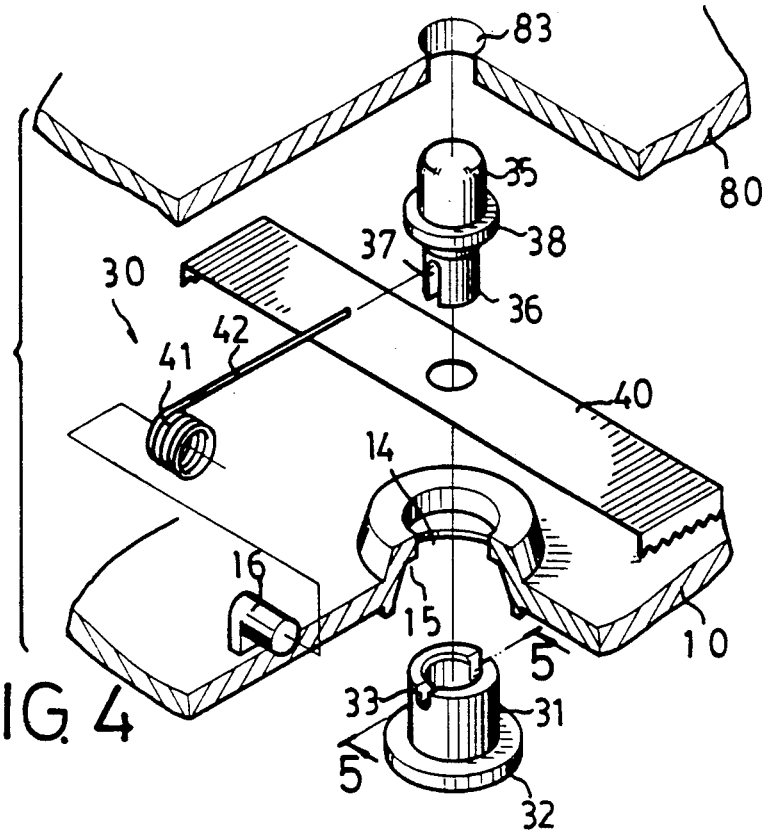
FIG. 4 is an exploded view of a switching means.
Figure 5:
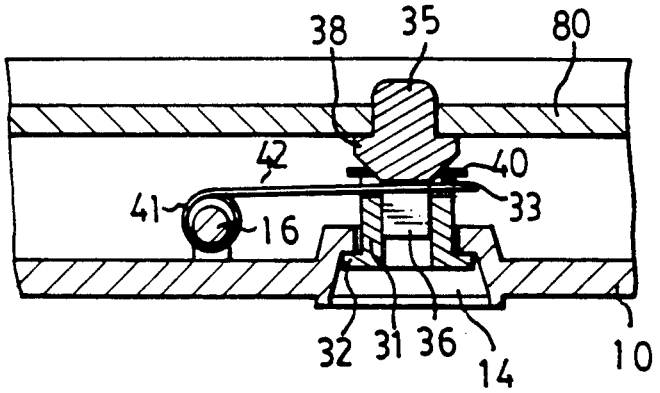
FIG. 5 is a cross sectional view taken along lines 5—5 of FIG. 4.

Referring next to FIGS. 4 and 5, a plurality of openings 14 are formed in the base 10, and one of the openings 14 is located between every two adjacent conductors 20, 21. A shoulder 15 is formed in each of the openings 14. A plurality of stubs 16 are integrally formed on the base 10 and extended horizontally; in which a stub 16 is disposed beside each of the openings 14. Each of the switching means 30 comprises a plurality of sleeves 31 each slidably received in a respective opening 14 of the base 10. Each of the sleeves 31 includes an annular flange 32 formed on the lower portion thereof and engageable with the shoulder 15 so that the upward movement of the sleeve 31 can be limited, and a pair of notches 33 formed in the upper portion thereof. A button 35 has a lower end 36 force-fitted within each of the sleeves 31 and has an annular flange 38 formed in the middle portion thereof. A groove 37 is formed in the lower end 36 of each of the buttons 35.

A conducting sheet 40 is engaged between the annular flange 38 of the button 35 and the upper edge of the sleeve 31. A spring 41 is engaged on each of the stubs 16 and has an arm 42 extended therefrom. The arm 42 extends through the notches 33 of the sleeve 31 and the groove 37 of the button 35 so that the button 35 can be resiliently supported by the spring 41 and so that the upper end of each of the buttons 35 can be biased upward through a respective hole 83 of the board 80. The conducting sheets 40 can be caused to contact with the respective conductors 20, 21 when the buttons 35 are depressed downward against the springs 41 by the jigsaw pieces 82. The switching means 30 and the puzzle pieces 82 are arranged such that one switching means 30 is located within the area of every puzzle piece 82; i.e., every switching means 30 is preferably depressed by one puzzle piece 82.

Figure 6:
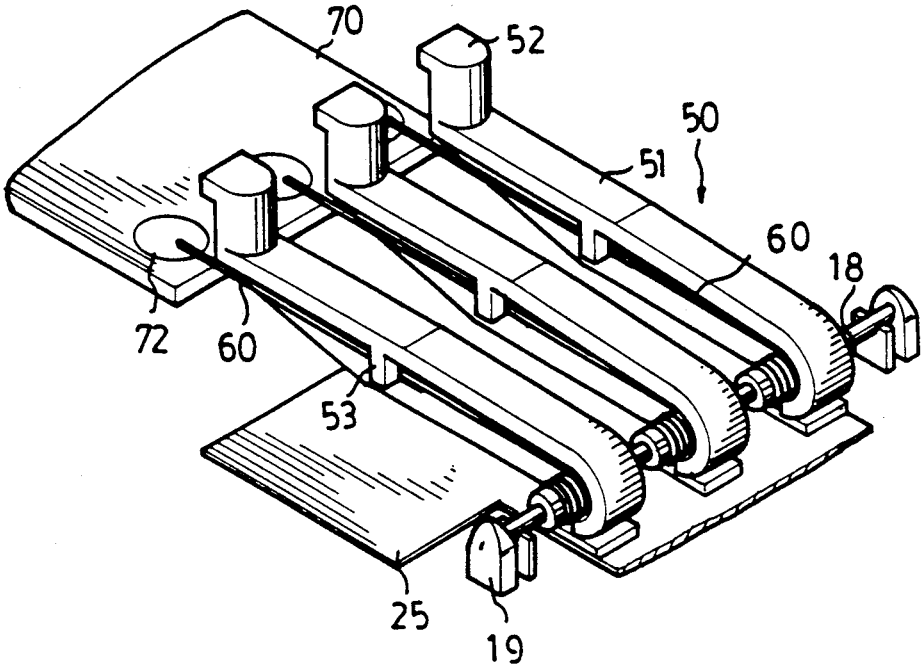
FIG. 6 is a partial perspective view of a switch.
Figure 7:
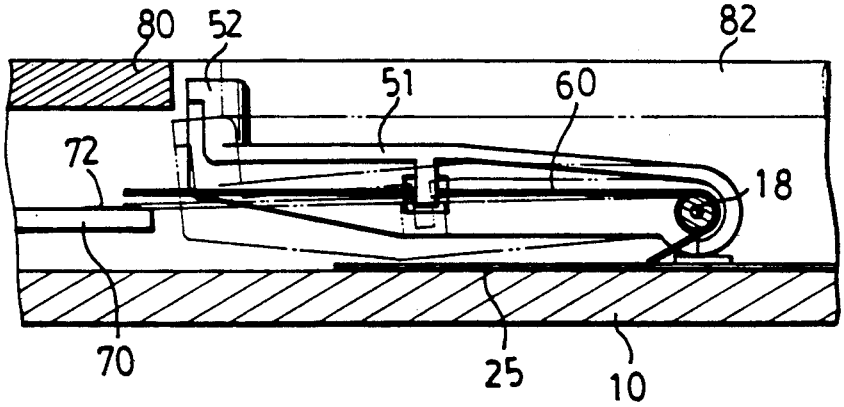
FIG. 7 is a side view of the switch.

Referring next to FIGS. 6 and 7, three switching means 50 are disposed upon the extension 25 of the first conductor 20 and each comprises an elongated limb 51 having one end pivotally supported on a shaft 18 which is supported on the base 10 by a pair of stays 19 and having a knob 52 extended upward from the other end thereof. A lug 53 extends downward from the middle portion of each of the limbs 51. A spring 60 has one end coupled on the shaft 18 and engaged with the extension 25 of the first conductor 20 and has the other end located above the plate 70 on which the speaker 71 is disposed. The middle portion of the spring 60 is engaged in the lug 53 of each of the limbs 51 so that the limbs 51 can be resiliently supported by the springs 60. As shown in FIGS. 1 and 6, three conducting points 72 are provided on the plate 70 and are arranged such that each of the springs 60 will electrically contact a respective conducting point 72 when the respective knob 52 is depressed downward.

Figure 8:
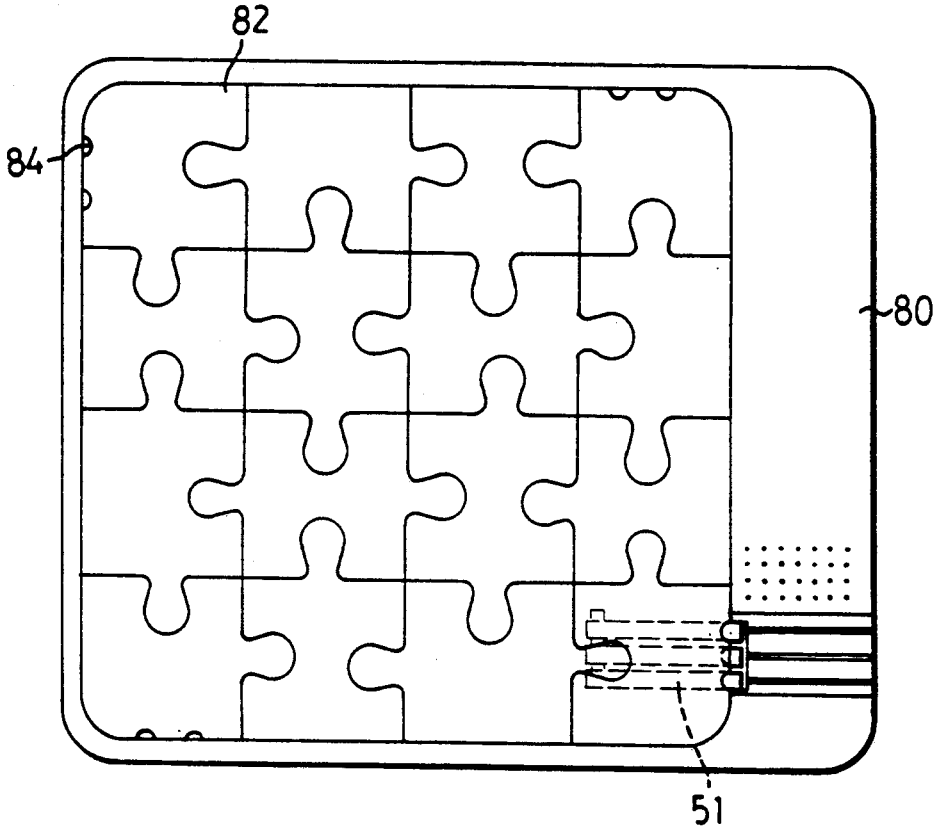
FIG. 8 is a top plane view of the jigsaw puzzle.

Referring next to FIG. 8, one set of jigsaw pieces 82 is arranged within the recess 81 of the board 80 and includes a jigsaw piece located in each of the four corner areas thereof. At least one of the jigsaw pieces located at the four corner areas has two indentations 84 formed in one side thereof corresponding to the location of the switching means 50. In this set of jigsaw pieces 82, the indentations 84 are formed and arranged such that the knobs 52 located on the outer sides of the three knobs 52 extend through the respective indentations 84 and will not be depressed by the jigsaw piece 82, while the knob 52 located between the other two will be depressed by the jigsaw 82 so that the spring 60 will be caused to contact the middle conducting point 72. Similarly, the indentations 84 are formed such that one and only one of the knobs 52 will be depressed.

In operation, when all of the buttons 35 are depressed by the jigsaw pieces, and when one of the knobs 52 is depressed and the spring 60 contacts the conducting point 72, a closed circuit of the jigsaw puzzle is formed and includes the conductors 20, 21, 40, the extensions 25, 26, the spring 60, the conducting point 72 and the speaker 71. The closed circuit preferably comprises at least one battery and at least one musical Integrated Circuit (IC) (not shown) disposed in the plate 70 such that the speaker 71 sends out a musical sound or a voice when the closed circuit is formed, and such that the speaker 71 sends out a different musical sound or a voice when either of the knobs 52 is depressed.

Accordingly, the jigsaw puzzle in accordance with the present invention sends out a musical sound or a voice when one set of jigsaw pieces are correctly disposed within the recess 81 of the board 80.

Alternatively, without the switching means 50 and without the IC, the speaker 71 can be directly connected between the first and the last conductors 20 and can be energized when all of the buttons 35 are depressed. The speaker 71 can be replaced by a buzzer or the like in order to send out a different sound.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A jigsaw puzzle comprising a base, a plurality of conductors disposed on said base and arranged in a line and including a first conductor and a last conductor, a first switching means disposed between every two adjacent conductors, a plurality of jigsaw pieces which can be disposed upon said first switching means, a sounding means connected between said first conductor and said last conductor, and said sounding means sending out a sound when all of said first switching means are depressed by all said jigsaw pieces and when all of said jigsaw pieces are correctly disposed in place.

2. A jigsaw puzzle according to claim 1, wherein each of said conductors includes two side walls each having at least one lug extending downward therefrom and each having at least one depression formed therein, said base has a plurality of slots formed therein and has a hook disposed beside each of said slots, each of said lugs of said conductors is received in a respective slot of said base, and each of said hooks is engaged in a respective depression so that said conductors can be retained in place.

3. A jigsaw puzzle according to claim 1 further comprising a board disposed upon said base and including a plurality of holes formed therein, each of said first switching means comprising a button extendible upward beyond each of said holes of said board, a spring disposed beside each of said buttons for biasing said buttons upward beyond said board, a conducting sheet engaged on each of said buttons, said conductors being connected together to form a closed circuit when all of said buttons are depressed by said jigsaw pieces and when said jigsaw pieces are correctly disposed on said board.

4. A jigsaw puzzle according to claim 3, wherein said base includes a plurality of openings formed therein, each of said switching means comprises a sleeve slidably received in each of said openings of said base, each of said buttons has a lower end engaged in a respective sleeve, said conducting sheet is engaged between said button and said sleeve, each of said buttons has a groove formed therein, each of said springs has an arm extended through said groove of a respective button for biasing said button upward.

5. A jigsaw puzzle according to claim 1, wherein said first conductor includes an extension extended therefrom, said jigsaw puzzle further comprising at least two second switching means each including a knob and a spring for biasing said knob upward, one end of each of said springs being contacted with said first conductor, a plate disposed between said first and said last conductors, said sounding means being disposed on said plate, at least two conducting points being formed on said plate, said spring being caused to be electrically connected between said first conductor and a respective conducting point when said knob is depressed downward by one of said jigsaw pieces, one of said jigsaw pieces having at least one indentation formed therein and arranged such that only one of said knobs is depressed downward.

6. A jigsaw puzzle according to claim 5, wherein said base has a shaft disposed thereon, each of said second switching means comprises a limb having a first end pivotally coupled to said shaft and having a second end and having a lug extended downward from a middle portion thereof, said knob is formed on said second end of each of said limbs, said spring is engaged on said lug of a respective limb for biasing said knob upward and is caused to contact said conducting point when said knob is depressed.

* * * * *